US006142231A

United States Patent [19]

Myers, Jr. et al.

[11] Patent Number: 6,142,231

[45] **Date of Patent: *Nov. 7, 2000**

[54] ONE-TRIP CONVEYING METHOD FOR PACKER/PLUG AND PERFORATING GUN

[75] Inventors: William D. Myers, Jr., Houston, Tex.; Kare-Jonny Haugvalstad, Godalstunet, Norway; Robert K. Bethel, Houston, Tex.; Kelly D. Ireland, The Woodlands, Tex.; Timothy W. Sampson, Spring, Tex.

[73] Assignee: Baker Hughes Incorporated, Houston, Tex.

[ * ] Notice: This patent is subject to a terminal disclaimer.

[21] Appl. No.: 08/758,655

[22] Filed: Dec. 2, 1996

Related U.S. Application Data

[63] Continuation of application No. 08/501,199, Jul. 11, 1995, Pat. No. 5,611,401.

[51] Int. Cl.[7] ..... E21B 43/17

[52] U.S. Cl. ..... 166/297; 166/55.1; 175/4.52

[58] Field of Search ..... 166/297, 55.1; 175/4.52

[56] References Cited

U.S. PATENT DOCUMENTS

| | | |
|---|---|---|
| 2,637,402 | 5/1953 | Baker et al. . |
| 2,986,214 | 5/1961 | Wiseman, Jr. et al. . |
| 3,024,843 | 3/1962 | Hanes . |
| 3,160,209 | 12/1964 | Bonner . |
| 3,398,803 | 8/1968 | Leutwyler et al. . |
| 4,375,834 | 3/1983 | Trott . |
| 4,436,155 | 3/1984 | Brieger . |
| 4,541,486 | 9/1985 | Wetzel et al. . |
| 4,566,538 | 1/1986 | Peterson . |
| 5,226,494 | 7/1993 | Rubbo et al. . |
| 5,343,963 | 9/1994 | Bouldin et al. . |
| 5,396,951 | 3/1995 | Ross . |
| 5,456,316 | 10/1995 | Owens et al. . |

OTHER PUBLICATIONS

Baker Service Tools, Assembly, Running, and Disassembly of Basic Wireline Setting Tools Pressure Setting Assembly Firing Heads, and Wireline Feeler and Junk Catcher; Unio 4180, Apr. 26, 1985, 1–8, 25, 27, 30, 42–44.

Baker Packers Completion Systems, Technology Data Manual, Model "B" Wireline Adapter Kit, Unit 8209, Nov. 30, 1981, 8.

*Primary Examiner*—Hoang Dang

*Attorney, Agent, or Firm*—Duane, Morris & Heckscher LLP

[57] ABSTRACT

A one-trip system for placement and setting a downhole packer or plug is disclosed. The packer is settable in a variety of ways, including hydraulically, acoustically by pressure pulse signals, or some combination. Use of hydraulic pressure triggers a pressure-creating reaction to initiate the setting of the packer. The setting mechanism for the packer breaks clear of the packer upon setting and allows the tubing-conveyed perforating gun, which is already preassembled as part of the string, to be accurately positioned and fired.

14 Claims, 10 Drawing Sheets

ONE-TRIP CONVEYING METHOD FOR PACKER/PLUG AND PERFORATING GUN

This is a continuation of application Ser. No. 08/501,199, filed on Jul. 11, 1995, now the U.S. Pat. No. 5,611,401.

FIELD OF THE INVENTION

The field of this invention relates to completions and more particularly to the placement of a bridge plug or packer in the wellbore prior to perforating.

BACKGROUND OF THE INVENTION

In the past, packers or bridge plugs have been run into the wellbore on wireline to facilitate rapid positioning and setting. While use of an electric line or wireline packer or plug allows for rapid placement and deployment of such equipment, it requires the use of wireline equipment at the surface which is costly and which creates logistical concerns, particularly in offshore applications.

According to methods used in the past, after running and setting the packer with a wireline, a separate trip has to be made into the wellbore with the tubing-conveyed perforating gun. The need to run the perforating gun on rigid or coiled tubing has, in the past, necessitated this two-trip system when used in combination with packers which are run in on wireline.

Accordingly, it is one of the objects of the present invention to provide a simple system to run in one trip a packer and tubing-conveyed perforating gun. The packer can be easily set in the preferred manner hydraulically such that the setting mechanism releases from the packer, which in turn allows for simple positioning of the perforating gun for subsequent actuation.

Various signaling mechanisms for actuation of downhole tools have been developed. U.S. Pat. No. 5,226,494 indicates a signaling method using pressure-induced strains in tubing suspending a downhole tool to trigger an electronic circuit to actuate the tool. U.S. Pat. No. 5,343,963 also relates to measuring pressure-induced strain in the conveying tubing to trigger the operation of a downhole tool. Yet other devices have been developed that use acoustical signals or pressure pulses transmitted downhole which are received and converted to an electrical signal to actuate a downhole tool.

Creation of a motive pressure force to drive downhole components by initiating a chemical reaction is described in U.S. Pat. No. 5,396,951.

The prior techniques have not approached the simplicity and reliability of the present invention, which facilitates a one-trip operation and allows for considerable savings of rig time and surface equipment.

SUMMARY OF THE INVENTION

A one-trip system for placement and setting a downhole packer or plug is disclosed. The packer is settable in a variety of ways, including hydraulically, acoustically by pressure pulse signals, or some combination. Use of hydraulic pressure triggers a pressure-creating reaction to initiate the setting of the packer. The setting mechanism for the packer breaks clear of the packer upon setting and allows the tubing-conveyed perforating gun, which is already preassembled as part of the string, to be accurately positioned and fired.

DETAILED DESCRIPTION OF THE PREFERRED EMBODIMENT

Figure 1A:
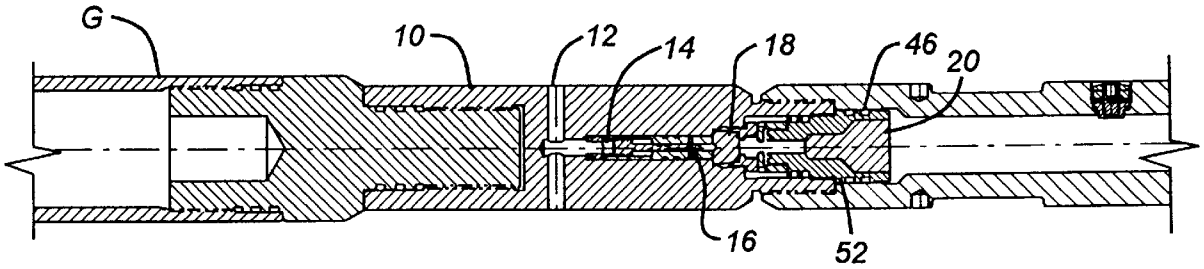
FIGS. 1A–1D are a split view of the setting tool for the packer in two positions, illustrating how the perforating gun is mounted thereto.
Figure 1B:
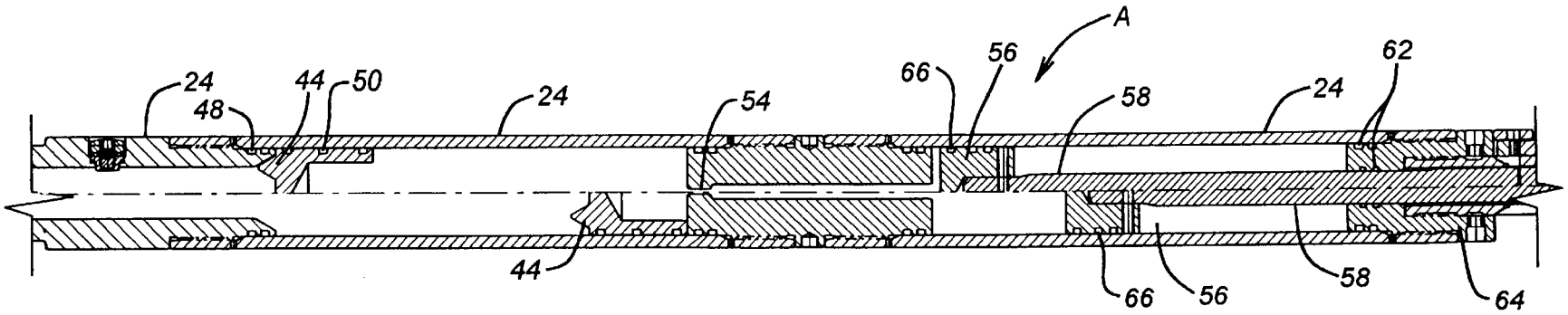
Figure 1C:
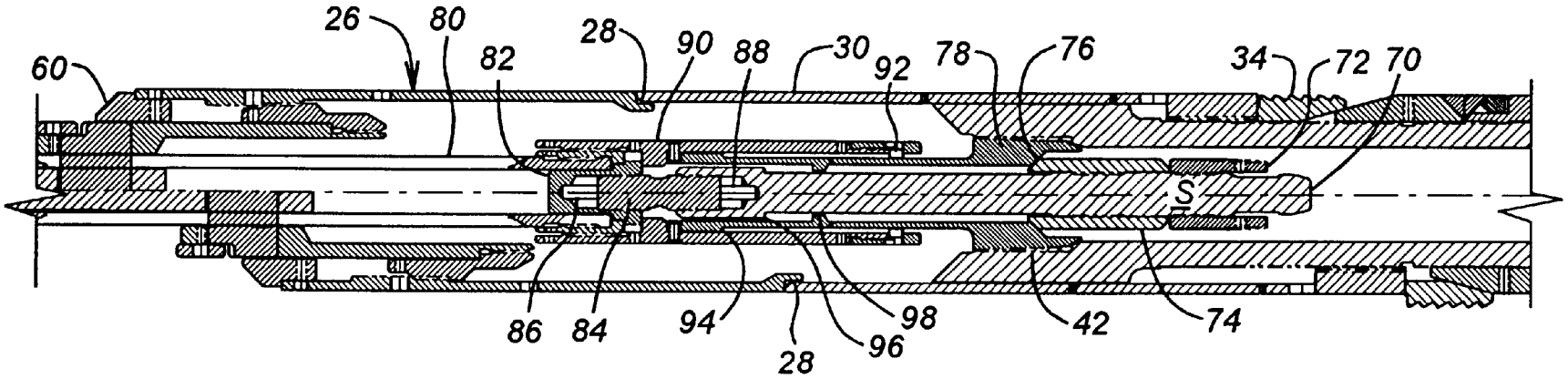
Figure 1D:
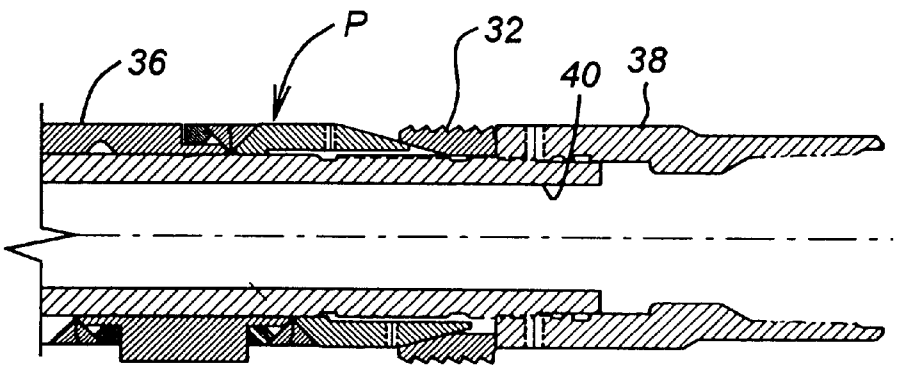

The apparatus A of the present invention is shown in FIG. 1. At the upper end a perforating gun is schematically illustrated as G. Below the perforating gun G is a top sub 10, which has a series of ports 12. Ports 12 are in communication with a rupture disk 14 which, when it breaks, activates hammer 16 to initiate a reaction between a commonly known initiator material 18, which reacts with a commonly known charge 20. This method of initiating a reaction in response to a mechanical movement is also illustrated in U.S. application Ser. No. 08/233,368 filed Apr. 25, 1994, entitled "Downhole Signal-Conveying System", which issued Oct. 10, 1995 as U.S. Pat. No. 5,456,316, and which is incorporated by reference herein as if fully set forth. The charge 20 is housed in body 24, which is made up of several components. Slidably mounted at the lower end of body 24 is an outer sleeve 26, which has a lower end 28, which in turn bears on the setting sleeve 30 of a typical packer P. It should be noted that the design of packer P is of a type well-known in the art, and its internal construction per se is not a part of the invention. As illustrated in FIG. 1, the packer P has lower slips 32 and upper slips 34. In between is a sealing element assembly 36 which, in the top portion of FIG. 1, is shown in the relaxed position and in the bottom portion of FIG. 1 is shown in the expanded position for sealing against a casing or a wellbore (not shown). Below lower slips 32 is bottom sub 38, which is connected to inner mandrel 40. Inner mandrel 40 of the packer P is secured to setting tool S at thread 42.

Those skilled in the art can see that the packer P is set by downward movement of setting sleeve 30 which is driven by the setting tool S, as will be described below, while at the same time setting tool S retains bottom sub 38 against downward movement by virtue of a connection through inner mandrel 40.

The setting tool S, as previously indicated, has a body 24 within which is disposed an initial piston 44. When the charge 20 is set off due to mixing with the initiator 18, pressure develops above piston 44. As seen in the split view of FIG. 1, piston 44 is driven downwardly. The pressure developed by the reaction between the initiator 18 and the charge 20 is prevented from escaping anywhere by a series of seals 46, 48, and 50. Seals 50 are on piston 44, while seals 48 are on body 24, and seals 46 are on internal sub 52. Accordingly, the pressure developed by the reaction between the initiator 18 and the charge 20 creates a force that moves piston 44. Piston 44 compresses oil through restriction 54. This meters (or slows) the setting force, preventing damage or a partial set of the packer. The restriction 54 is downstream of piston 44 and upstream of secondary piston 56. Secondary piston 56 has a piston rod 58 connected thereto. Piston rod 58 is ultimately connected to outer sleeve 26 for tandem movement through ring 60. Piston rod 58 is sealed with respect to body 24 through seals 62 on hub 64. Seals 66 seal the piston 56 against the body 24. The restriction 54 prevents overly rapid acceleration of piston 44. Movement of piston 44 ultimately results in a build-up of a force acting on piston 56 which causes piston 56 to shift downwardly. Once piston 56 moves downwardly, taking with it piston rod 58, the lower end 28 of outer sleeve 26 shifts downwardly, as can be seen in FIG. 1 by comparing one segment of the drawing to the other. The shifted position of the outer sleeve 26 results in displacement of the setting sleeve 30. At the same-time, the lower ring 38 on packer P is restrained from downward movement because it is being retained by inner mandrel 40 which is connected to the setting tool S at thread 42. The net result is that the slips 32 and 34 are driven outwardly, as is the sealing element assembly 36 on packer P to set the packer.

The apparatus A of the present invention is set to automatically release from the packer P upon setting packer P. The mechanism of how the setting of the packer P results in release therefrom by the setting tool S will now be described. The setting tool S has a release rod 70. Ring 72 is mounted on rod 70 and supports wedge ring 74. As shown in FIG. 1, wedge ring 74 has a tapered surface 76 which, in the run-in position shown in FIG. 1, is wedged under collets 78, which are externally threaded so that they can be engaged via thread 42 to mandrel 40. Those skilled in the art will appreciate that the wedging action of tapered surface 76 helps to retain the setting tool S to the mandrel 40. Additionally, there is no other connection to packer P other than a bearing by outer sleeve 26 setting on setting sleeve 30. Accordingly, when the collets 78 become undermined, as occurs when the packer P is set, the setting tool S can be removed from the packer.

As previously described, body 24 supports a hub 64, which in turn supports sleeve 80. Hub 82 is connected to sleeve 80. Tensile member 84 is connected to hub 82 by rod 86. In the preferred embodiment, tensile member 84 breaks at approximately a 50,000-lb. force.

Shaft 70, apart from its initial function of supporting the ring 74 with tapered surface 76 against the collets 78, further extends upwardly into contact with tensile member 84 through rod 88. Tensile member 84 can be threadedly connected to hub 82 and shaft 70. Hub 82 is connected to sleeve 90, which has a lug 92 to eventually catch shoulder 94 of the collet assembly 42.

When the tensile member 84 is subjected to a predetermined stress during the procedure for setting the packer P, a tensile force is transmitted to the tensile member 84 through tapered surface 76. Eventually, when the predetermined force, such as 50,000 lbs., is exceeded, the tensile member 84 breaks because it is firmly supported from above through sleeve 80 while it is being pulled at from below through ring 74. Upon separation of shearing member 84, shoulder 96 is caught on lug 98. This allows tapered surface 76 to back away from collets 78 and leave them unsupported. The entire assembly of the collets 78 is then retained on lug 92 of sleeve 90. An upward pull on the tubing string (not shown) which is connected above the perforating gun G results in removal of the setting tool S. This is because the collets 78 are no longer supported by tapered surface 76, allowing the collets 78 to flex radially inwardly to disengage the threaded connection 42. Alternatively, the setting tool S can be disengaged from the packer P by rotation, which will release the connection at thread 42. However, in deviated wellbores, it may be difficult to disengage by rotation and the rotational means of disengagement is intended to be used as a back-up if the components do not properly move to fully remove the support for collets 78. Once the setting tool S is disengaged from the packer P, the perforating gun G can be set at the desired location without another trip into the hole and fired.

Figure 2A:
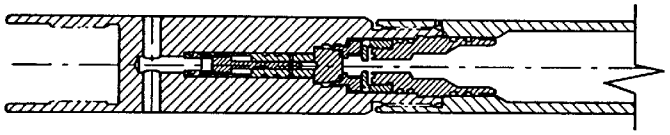
FIGS. 2*a*–2*c* are a view of the setting mechanism prior to its insertion into the packer for an embodiment triggered by hydraulic pressure which initiates a reaction creating a pressure to set the packer.
Figure 2B:
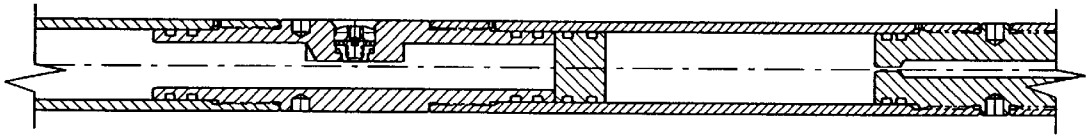
Figure 2C:
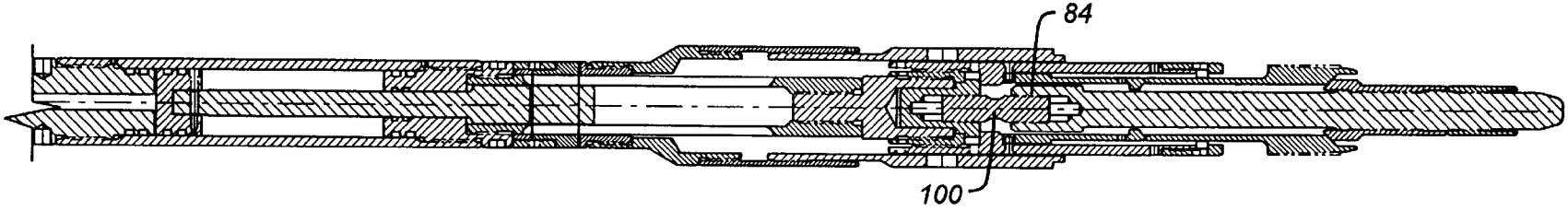
Figure 3A:
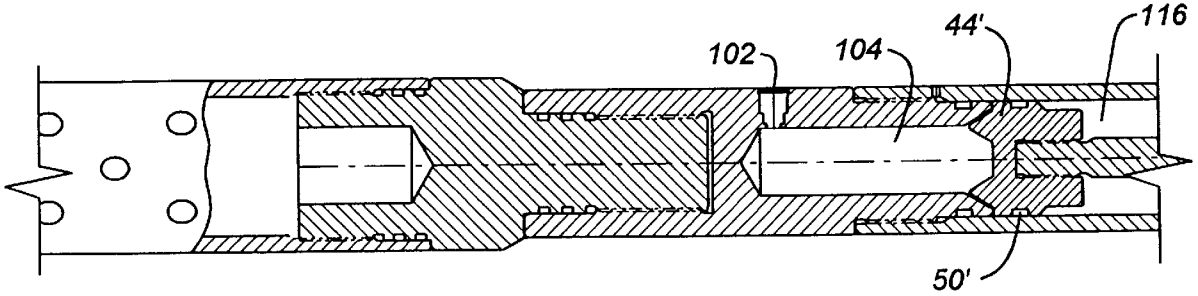
FIGS. 3*a*–3*d* are sectional elevational views of the apparatus of the present invention, showing an embodiment where rupture disks are broken to initiate the setting of the packer, with FIG. 3 showing the assembly with the packer and FIG. 4 illustrating the assembly in split view showing the run-in and set positions of the running tool.
Figure 3B:
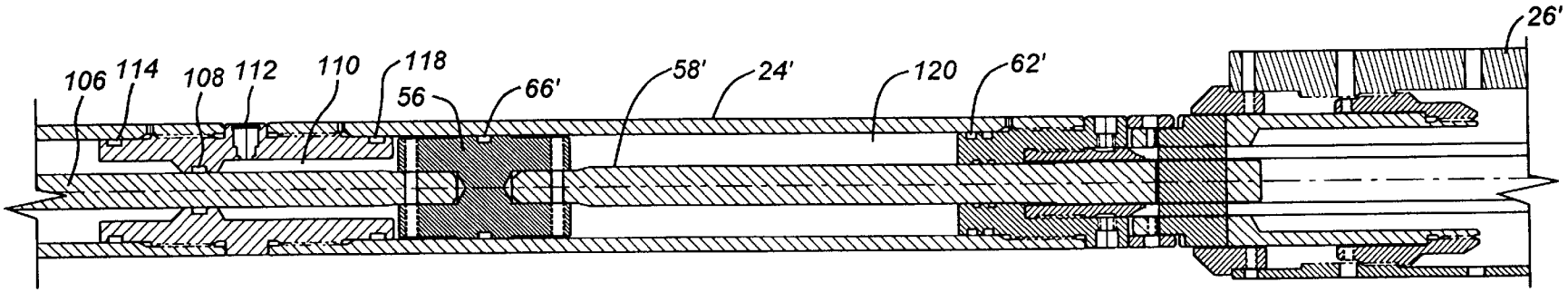
Figure 3C:
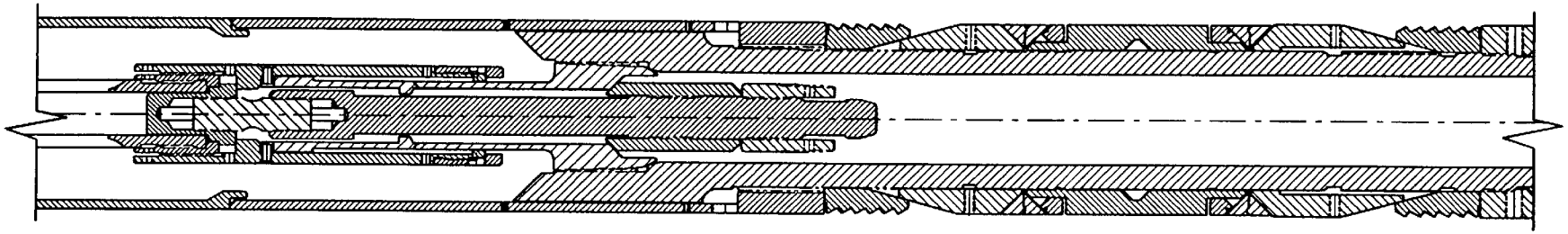
Figure 3D:
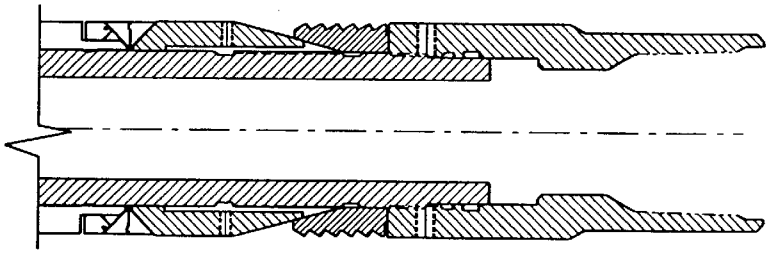

FIG. 2 is an illustration of the setting tool S shown separately from the packer P. Noted in dashed line 100 on FIG. 2 is the manner in which the tensile member 84 breaks after being subjected to the predetermined force.

Figure 4A:
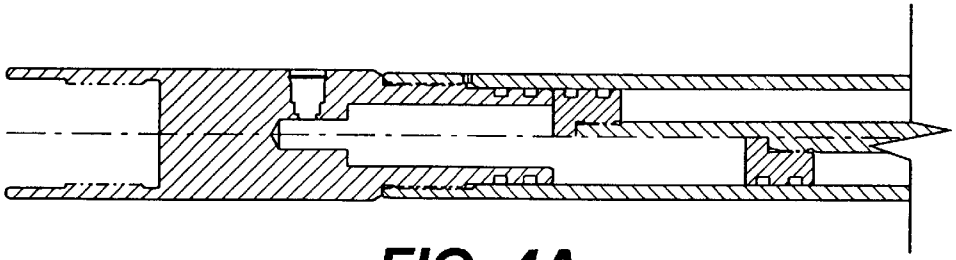
Figure 4B:
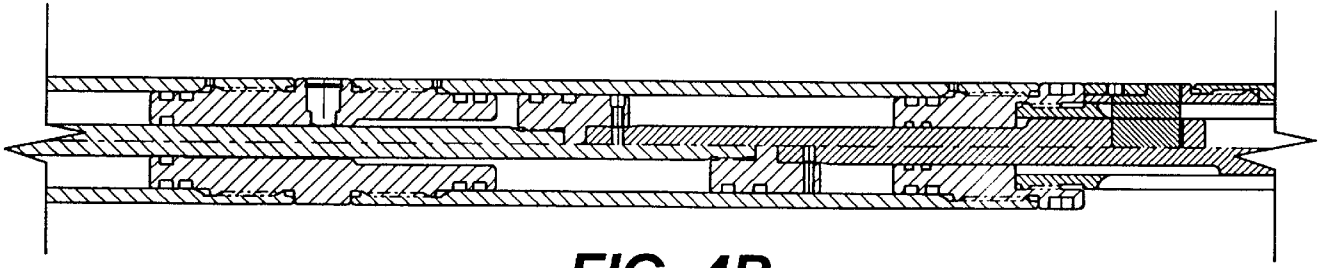
Figure 4C:
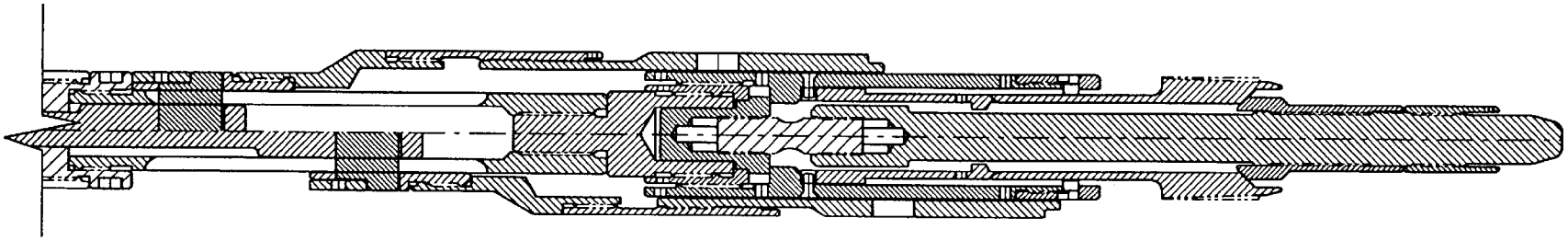
Figure 5A:
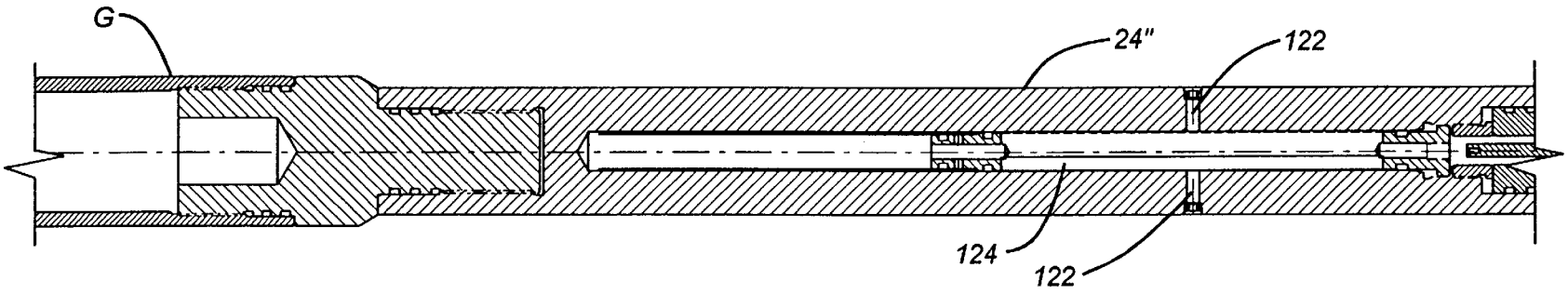
FIGS. 5*a*–5*d* and 6*a*–6*c* in sectional elevation indicate another embodiment of FIGS. 1–4 wherein a strain gauge signal triggers the pressure-creating reaction to set the packer and release therefrom, as shown in split view in FIGS. 5*a*–5*d*, with the packer assembly and without the packer in the run-in position for the setting tool in FIGS. 6*a*–6*c*.
Figure 5B:
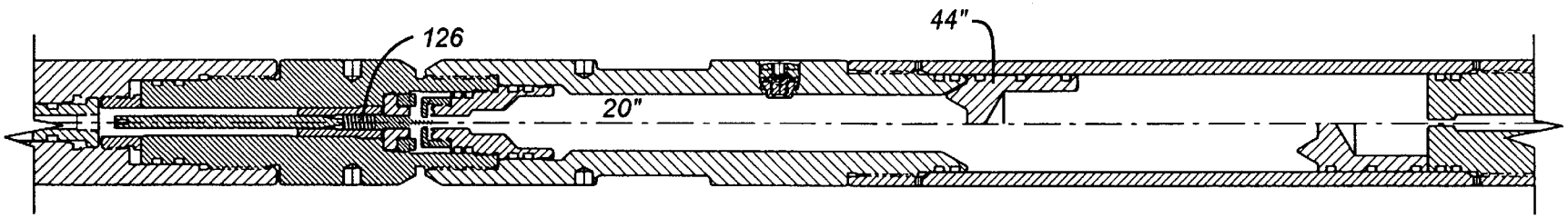
Figure 5C:
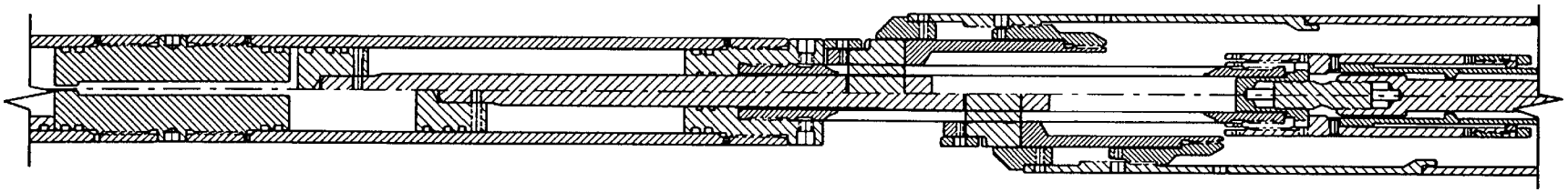
Figure 5D:
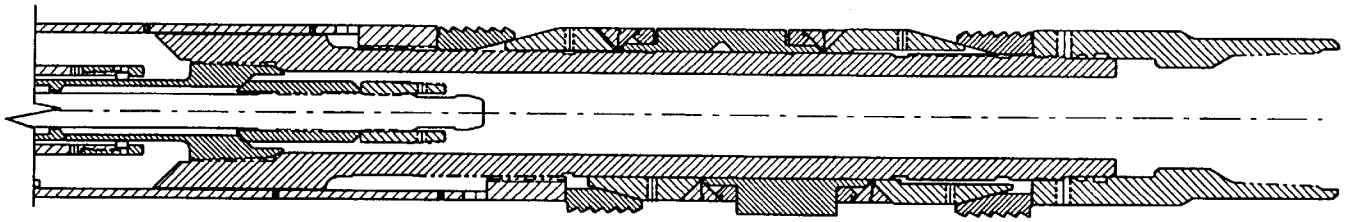

FIG. 3 is in all ways identical to the embodiment shown in FIG. 1; however, the actuating mechanism to move the outer sleeve 26' is a little bit different. In FIG. 3, an initial rupture disk 102 communicates into cavity 104, which is directly above the initial piston 44'. In this embodiment, the initial piston 44' is connected to the secondary piston 56' by a piston rod 106. Rod 106 extends through seal 108 to define cavity 110. A second rupture disk 112 is in communication with cavity 110 and is set to burst preferably at the same pressure as rupture disk 102, but different pressures can also be used. As before, seals 50' seal initial piston 44' against body 24'. Accordingly, seals 50', 108, and 114 seal off cavity 116 through which the piston rod 106 extends. Cavity 116 is initially filed with a compressible fluid such as air so that it can have its volume reduced as piston 44' moves in response to built-up pressure when rupture disk 102 breaks. Similarly, at the same or a higher pressure when rupture disk 112 breaks, seals 66', 108, and 118 seal off cavity 110 to allow pressure to build up on secondary piston 56'. Cavity 120 is sealed off by seals 62' and 66', and contains a compressible fluid such as air to allow pistons 44' and 56' to advance under the initial force when rupture disk 102 breaks and the subsequent boost force applied when rupture disk 112 breaks. Those skilled in the art will appreciate that in the embodiment shown in FIGS. 3 and 4, the primary and secondary pistons 44' and 56' are rigidly connected to each other by rod 106 for tandem movement. Ultimately, a rod 58' extends from piston 56' to operate the outer sleeve 26' and the other components in the same manner as previously described for FIGS. 1 and 2.

Figure 6A:
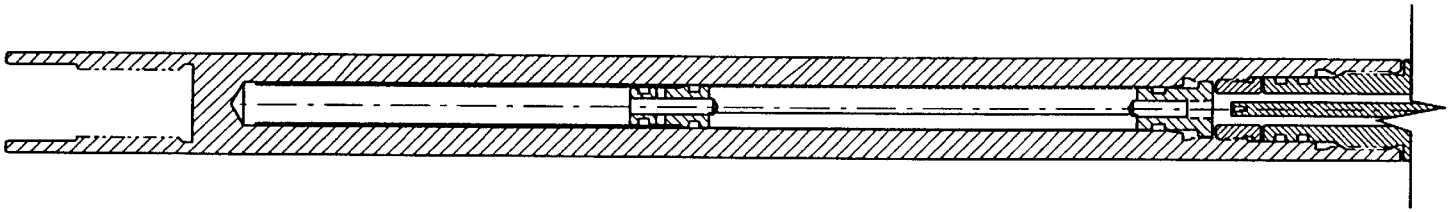
Figure 6B:
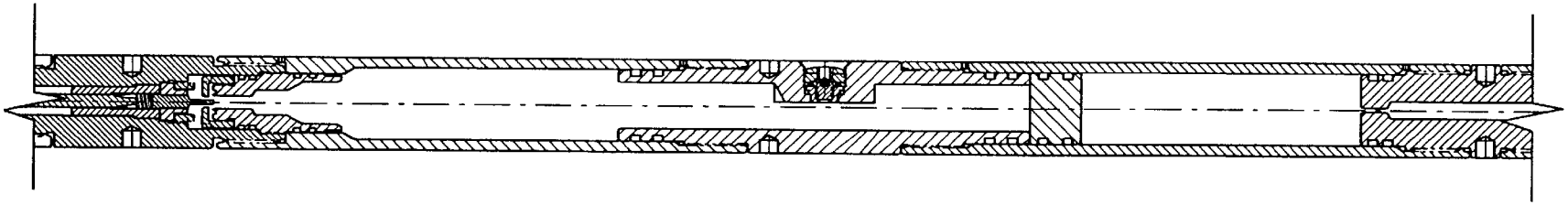
Figure 6C:
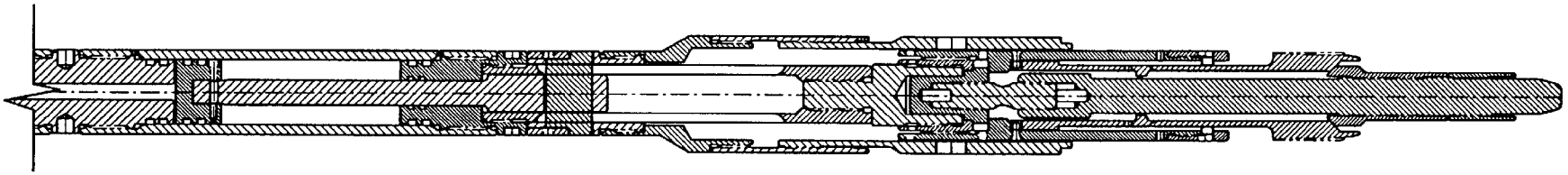

FIGS. 5 and 6 bear a great resemblance to the embodiment shown in FIGS. 1 and 2, except the method for actuation of the pressurizing reaction for the initial piston 44" is somewhat different. The construction of the packer P and the setting tool S below the initial piston 44" is otherwise the same as the embodiment in FIGS. 1 and 2. In this embodiment, a similar setting system, akin to that shown in U.S. Pat. Nos. 5,226,494, 5,343,963, and 5,396,951, is schematically illustrated to initiate the initial reaction to create pressure above initial piston 44". As in two of the referenced patents, a strain gauge or gauges 122, responsive to the stresses measured at body 24", signals a control circuit 124 to initiate a signal to a heating element 126. The heat generated by element 126 initiates a reaction which creates pressure in cavity 20' when materials, such as described in U.S. Pat. No. 5,396,951, react, causing the pressure build-up. Thereafter, the operation of the embodiment of FIG. 5 is the same as that of FIG. 1. It should be noted that the configuration of FIGS. 5 and 6 is intended to be in part schematic and is amenable to related means of initiating a pressurizing reaction in chamber 20", such as by the sending from the surface of an acoustical signal or a pressure-pulse signal and its receipt at the control circuit 124 via means alternative to the strain gauges 122. Instead, a signal receiver of the type known in the art can accept an incoming acoustical signal, pressure pulse, or a physical movement signal, and convert it to an output electrical signal by using the control circuit 124 to in turn actuate a mechanism not necessarily limited to a heater 126 to initiate a reaction or to otherwise initiate or liberate a force sufficient to move piston 44". Thus, in lieu of strain gauges 122, the circuit 124 can be sensitized to a predetermined pattern of movement of the entire assembly to set and release from packer P and/or to fire gun G.

Those skilled in the art will appreciate that what is disclosed in the apparatus and method of the present invention is a one-trip system where, on coiled or rigid tubing, the perforating gun G can be lowered and located in the wellbore along with the packer P in one trip. The setting tool S, already connected and supporting the packer P, can be actuated in a variety of ways as described above. Having set the packer P, the setting tool S is released automatically from the packer P and retrieved therefrom by manipulation of the rigid or coiled tubing which supports the gun G. Thereafter, having removed the setting assembly from the packer, the gun G is properly positioned and set off to complete the perforating procedure. Thereafter, to conclude the one trip, the assembly of the gun and the setting tool is removable from the wellbore.

The foregoing disclosure and description of the invention are illustrative and explanatory thereof, and various changes in the size, shape and materials, as well as in the details of the illustrated construction, may be made without departing from the spirit of the invention.

What is claimed is:

1. A one-trip well completion method, comprising:

running in a perforating gun and a packer on tubing;

setting the packer;

automatically releasing said gun from said packer as a result of setting said packer;

firing said perforating gun;

removing said gun from the wellbore;

using a setting tool to set the packer;

securing said setting tool to said packer with a tensile element;

releasing said packer by breaking said tensile element when setting said packer;

securing support for at least one collet with said tensile element; and using said collet when supported to secure said setting tool to said packer.

2. The method of claim 1, further comprising:

undermining support of said collet by said breaking.

3. The method of claim 2, further comprising:

initiating pressure building in said setting tool;

creating differential movement due to said pressure building;

setting the packer with said differential movement.

4. The method of claim 3, further comprising:

using said differential movement to break a tensile member on said setting tool;

releasing said setting tool from said packer by said breaking.

5. The method of claim 3, further comprising:

using hydraulic pressure to initiate said pressure building;

moving at least one piston by said pressure building.

6. The method of claim 5, further comprising:

using connected pistons in said setting tool;

applying an initial force to said pistons;

applying a boost force to said pistons.

7. The method of claim 6, further comprising:

using a first rupture disk to provide a hydraulic force above said pistons;

using a second rupture disk to provide a boost force between said pistons.

8. The method of claim 3, further comprising:

moving an initial piston by said pressure building;

using movement of said first piston to build pressure on a second piston;

controlling the speed of said first piston.

9. The method of claim 3, further comprising:

using a restriction between said pistons;

forcing said first piston to push fluid through said restriction to control its speed.

10. The method of claim 9, further comprising:

connecting said second piston to a setting sleeve on the packer for actuation thereof;

supporting another portion of the packer by a mandrel on said setting tool which is circumscribed by said second piston.

11. A one-trip well completion method, comprising:

running in a perforating gun and a packer on tubing into a deviated wellbore;

setting the packer;

releasing said gun from said packer;

firing said gun without use of a wireline signal;

removing said gun from the wellbore;

using a setting tool to set the packer;

securing said setting tool to said packer with a tensile element;

releasing said packer by breaking said tensile element when setting said packer;

securing support for at least one collet with said tensile element; and using said collet when supported to secure said setting tool to said packer.

12. The method of claim 11, further comprising:

undermining support of said collet by said breaking.

13. The method of claim 12, further comprising:

initiating pressure building in said setting tool;

creating differential movement due to said pressure building;

setting the packer with said differential movement.

14. The method of claim 13, further comprising:

using said differential movement to break a tensile member on said setting tool;

releasing said setting tool from said packer by said breaking.

* * * * *